US011749912B2

(12) United States Patent
Ito

(10) Patent No.: US 11,749,912 B2
(45) Date of Patent: Sep. 5, 2023

(54) TERMINAL-EQUIPPED ELECTRIC WIRE

(71) Applicant: Yazaki Corporation, Tokyo (JP)

(72) Inventor: Naoki Ito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/695,792

(22) Filed: Mar. 15, 2022

(65) Prior Publication Data

US 2022/0311154 A1 Sep. 29, 2022

(30) Foreign Application Priority Data

Mar. 23, 2021 (JP) ..... 2021-048008

(51) Int. Cl.

| | |
|---|---|
| ***H01R 4/18*** | (2006.01) |
| ***H01R 4/02*** | (2006.01) |
| ***H01R 4/24*** | (2018.01) |
| ***H01R 43/02*** | (2006.01) |

(52) U.S. Cl.

CPC ..... *H01R 4/187* (2013.01); *H01R 4/02* (2013.01); *H01R 4/24* (2013.01); *H01R 43/0221* (2013.01)

(58) Field of Classification Search

CPC . H01R 4/187; H01R 4/02; H01R 4/24; H01R 43/0221; H01R 4/023

See application file for complete search history.

(56) References Cited

U.S. PATENT DOCUMENTS

| | | | | |
|---|---|---|---|---|
| 3,601,783 | A * | 8/1971 | Loose | H01R 4/024 439/885 |
| 4,385,794 | A | 5/1983 | Lucius | |
| 4,593,963 | A | 6/1986 | Endo et al. | |
| 4,926,548 | A * | 5/1990 | Hopkins | H01R 4/2462 29/866 |
| 5,423,474 | A * | 6/1995 | Kanagawa | H01R 4/2495 228/136 |
| 5,913,695 | A * | 6/1999 | Okabe | H01R 4/2466 439/397 |
| 6,102,728 | A | 8/2000 | Shinchi | |
| 9,640,879 | B2 * | 5/2017 | Tanaka | H01R 43/28 |

(Continued)

FOREIGN PATENT DOCUMENTS

| | | |
|---|---|---|
| DE | 19717317 A1 | 10/1998 |
| JP | S60-136107 A | 7/1985 |

(Continued)

*Primary Examiner* — Oscar C Jimenez
*Assistant Examiner* — Paul D Baillargeon
(74) *Attorney, Agent, or Firm* — KENEALY VAIDYA LLP

(57) ABSTRACT

A terminal-equipped electric wire includes an electric wire in which a core wire including a plurality of strands is covered with a covering, and a terminal fitting attached to the electric wire. The terminal fitting includes a core wire connection body physically and electrically connected to the core wire. The core wire connection body has a bottom, a pair of cantilever side walls erected from the bottom and arranged facing each other with a space therebetween, and at least one set of paired pressure contact bodies arranged facing each other with a space therebetween between the pair of side walls so as to come into pressure contact with the strands in an outermost layer of the core wire.

4 Claims, 5 Drawing Sheets

(56) References Cited

U.S. PATENT DOCUMENTS

| | | | | |
|---|---|---|---|---|
| 2005/0029325 | A1* | 2/2005 | Sakamoto | H01R 4/2454 228/3.1 |
| 2015/0060135 | A1 | 3/2015 | Handel et al. | |
| 2019/0165493 | A1* | 5/2019 | Warashina | H01R 4/187 |
| 2021/0359430 | A1 | 11/2021 | Miyata et al. | |

FOREIGN PATENT DOCUMENTS

| | | | |
|---|---|---|---|
| JP | S61-112575 | U | 7/1986 |
| JP | H08-115756 | A | 5/1996 |
| JP | H10-172621 | A | 6/1998 |
| JP | 2016-1551 | A | 1/2016 |
| WO | 2020/110526 | A1 | 6/2020 |

* cited by examiner

TERMINAL-EQUIPPED ELECTRIC WIRE

CROSS-REFERENCE TO RELATED APPLICATION(S)

The present application claims priority to and incorporates by reference the entire contents of Japanese Patent Application No. 2021-048008 filed in Japan on Mar. 23, 2021.

BACKGROUND OF THE INVENTION

1. Field of the Invention

The present invention relates to a terminal-equipped electric wire.

2. Description of the Related Art

There is known a conventional terminal-equipped electric wire including an electric wire in which a core wire including a plurality of strands is covered with a covering, and a terminal fitting attached to the electric wire. For example, in such a terminal-equipped electric wire, the core wire and the terminal fitting are physically and electrically connected by bringing a pair of pressure contact bodies provided in the terminal fitting into pressure contact with the core wire. For instance, Japanese Utility Model Application Laid-open No. S61-112575 discloses this type of terminal-equipped electric wire.

In such a conventional terminal-equipped electric wire, the pair of pressure contact bodies are brought into pressure contact with the core wire from its outer surface side. Thus, as the number of strands constituting the core wire increases, the number of strands not in direct contact with the pressure contact bodies (non-contact strands) increases with respect to the number of strands in direct contact with the pressure contact bodies (contact strands). The non-contact strands of the core wire are indirectly electrically connected to the pressure contact bodies via the contact strands. Thus, in the conventional terminal-equipped electric wire, electrical resistance between the strands of the core wire is apt to rise, resulting in an increase in electrical resistance in a connection portion between the core wire and the terminal fitting. The conventional terminal-equipped electric wire has room for improvement in terms of enhancing electrical connection stability between the core wire and the terminal fitting.

SUMMARY OF THE INVENTION

It is an object of the present invention to provide a terminal-equipped electric wire capable of enhancing electrical connection stability between a core wire and a terminal fitting.

To achieve the above object, a terminal-equipped electric wire includes an electric wire in which a core wire including a plurality of strands is covered with a covering; and a terminal fitting attached to the electric wire, wherein the terminal fitting includes a core wire connection body physically and electrically connected to the core wire, the core wire connection body has a bottom, a pair of cantilever side walls erected from the bottom and arranged facing each other with a space therebetween, and at least one set of paired pressure contact bodies arranged facing each other with a space therebetween between the pair of side walls so as to come into pressure contact with the strands in an outermost layer of the core wire by cutting the covering of the electric wire inserted from an opening between respective free ends of the pair of side walls, and the electric wire is provided with a welded portion in which all the strands of the core wire are welded together.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
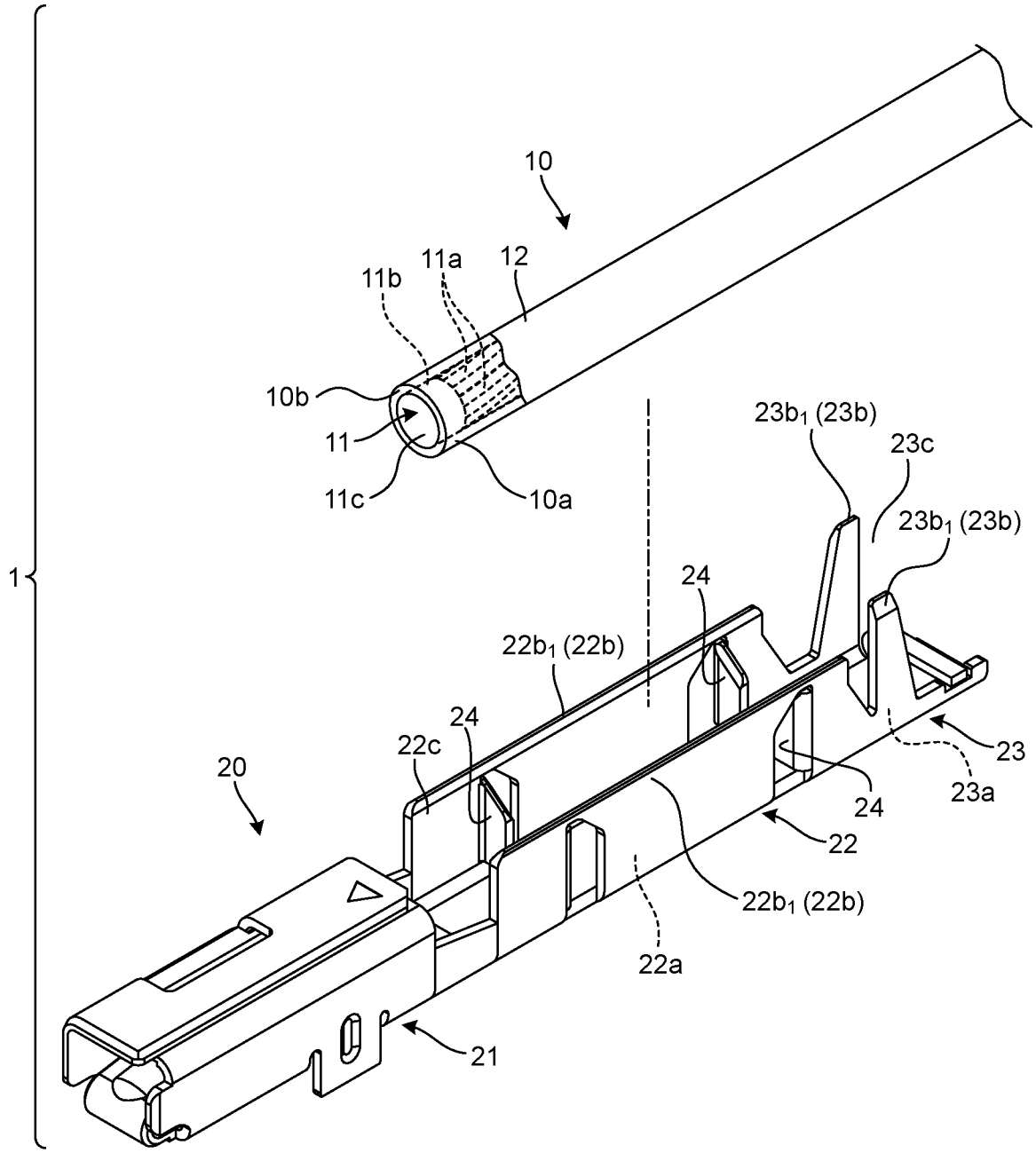
FIG. 1 is an exploded perspective view illustrating a terminal-equipped electric wire of an embodiment.

Hereinafter, an embodiment of a terminal-equipped electric wire according to the present invention will be described in detail based on the drawings. Note that the embodiment does not intend to limit the present invention.

Embodiment

One of embodiments of the terminal-equipped electric wire according to the present invention will be described based on FIGS. 1 to 6.

Reference numeral 1 in FIGS. 1 to 4 denotes a terminal-equipped electric wire of the present embodiment. The terminal-equipped electric wire 1 includes an electric wire 10 and a terminal fitting 20 attached to the electric wire 10. The electric wire 10 and the terminal fitting 20 are physically and electrically connected to each other.

The terminal-equipped electric wire 1 may be obtained by connecting the terminal fitting 20 to an end region of the electric wire 10, or by connecting the terminal fitting 20 to a portion between opposite ends of the electric wire 10. The terminal-equipped electric wire 1 may also be obtained by connecting at least one terminal fitting 20 to one electric wire 10, or by connecting a plurality of electric wires 10 by at least one terminal fitting 20, and electrically connecting the electric wires 10 via the terminal fitting 20. For example, when the terminal fitting 20 is formed so as to be physically and electrically connected to a mating terminal fitting by being fittingly connected to the mating terminal fitting, or so as to be physically and electrically connected to a mating electric connection portion by being screwed to the electric connection portion, the terminal fitting 20 is connected to an end region of at least one electric wire 10. Meanwhile, for example, when the terminal fitting 20 is formed as a joint terminal that electrically connects a plurality of electric wires 10, the terminal fitting 20 is connected to end regions of the electric wires 10 or portions between opposite ends of the electric wires 10. In this case, the terminal fitting 20 may be a joint terminal that physically and electrically connects the electric wires 10 to electrically connect all the electric wires 10 via the terminal fitting 20, or may be joint terminals, each of which physically and electrically connects at least two of the electric wires 10 as one set and is provided for each of the sets. In the terminal-equipped electric wire 1 described herein, the single terminal fitting 20 to be fitted and connected to the mating terminal fitting is connected to the end region of the single electric wire 10.

Figure 3:
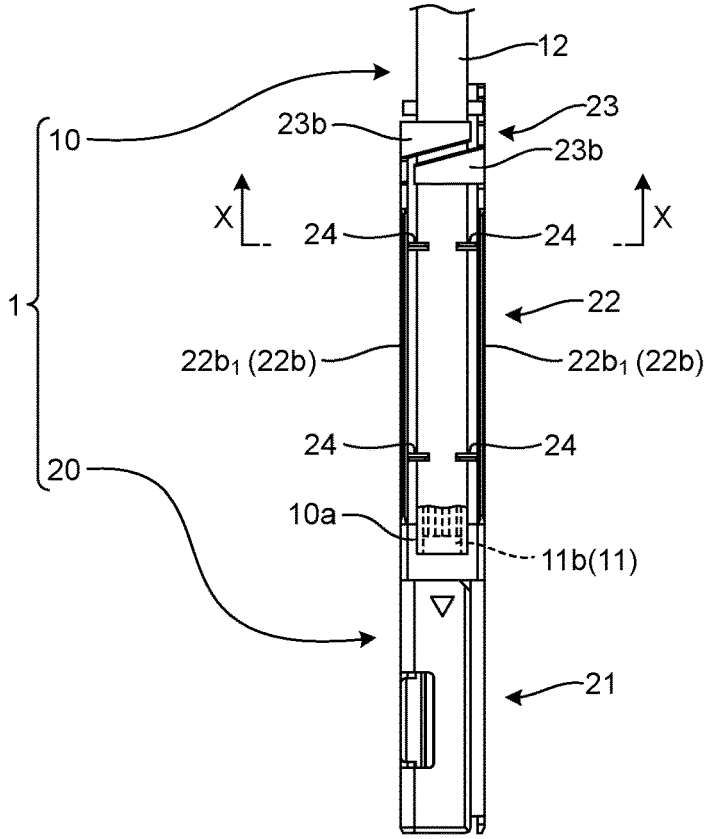
FIG. 3 is a plan view of the terminal-equipped electric wire of the embodiment as viewed from an opening side of a terminal fitting.
Figure 4:
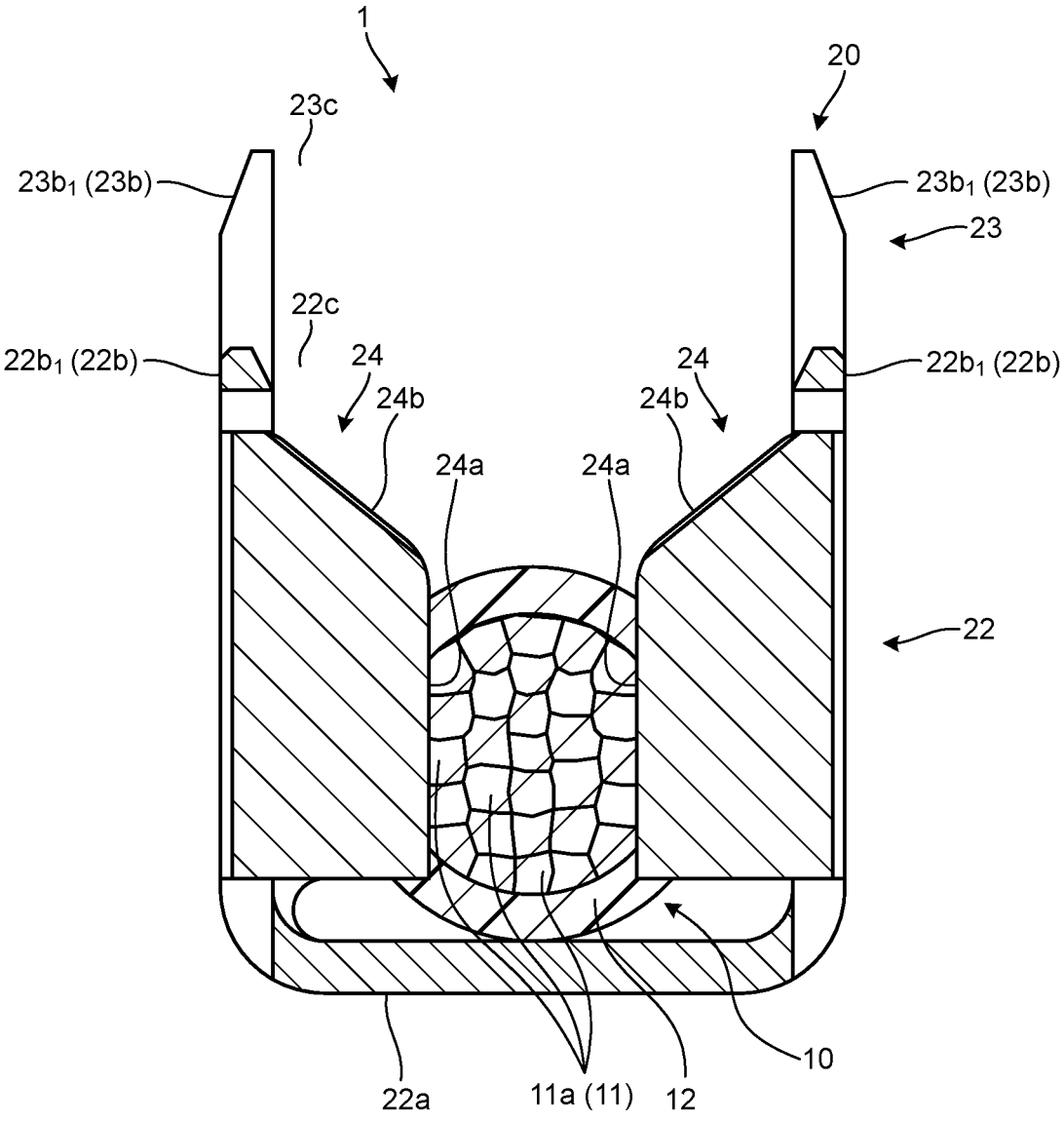
FIG. 4 is a schematic cross-sectional view taken along a line X-X in FIG. 3.

The electric wire 10 includes a core wire 11 including a plurality of strands 11*a*, and a covering 12 that covers the core wire 11 (FIGS. 1, 3, and 4). The electric wire 10 described herein includes the core wire 11 obtained by bundling in a columnar shape the strands 11*a* made of a conductive metal wire, and the cylindrical covering 12 that concentrically covers the core wire 11 from its outer surface side. The strands 11*a* are formed by, for instance, aluminum, aluminum alloy, copper, or copper alloy.

The core wire 11 may be obtained by bundling in the columnar shape the strands 11*a* whose axial directions are aligned with each other, or may be a twisted wire in which the strands 11*a* bundled in the columnar shape are twisted together. Moreover, the core wire 11 as the twisted wire may be obtained by twisting together all the strands 11*a* bundled in the columnar shape. The core wire 11 as the twisted wire may also be obtained by placing one strand 11*a* in the center and winding the remaining strands 11*a* around this strand 11*a*, or by forming a plurality of strand groups in which the strands 11*a* are twisted together, bundling the strand groups in a columnar shape, and twisting the strand groups together. In any form of the core wire 11 as described above, a plurality of strands 11*a* are arranged in an outermost layer, and a plurality of strands 11*a* are arranged inside the strands 11*a* in the outermost layer.

The terminal fitting 20 is formed by a conductive material such as metal. The terminal fitting 20 described herein is shaped by press-forming a metal plate as a base material. The terminal fitting 20 includes a terminal connection body 21 to be physically and electrically connected to a terminal connection body (not illustrated) of the mating terminal fitting, a core wire connection body 22 physically and electrically connected to the core wire 11 in the end region of the electric wire 10, and a covering connection body 23 physically connected to the covering 12 in the end region of the electric wire 10 (FIGS. 1 to 3).

For example, one of the terminal connection body 21 of the terminal fitting 20 and the terminal connection body of the mating terminal fitting is formed in a female terminal shape, and the other thereof is formed in a male terminal shape. The terminal connection bodies are inserted and fitted to each other. In this example, the terminal connection body 21 of the terminal fitting 20 is formed in a female terminal shape, and the terminal connection body of the mating terminal fitting is formed in a male terminal shape.

Figure 2:
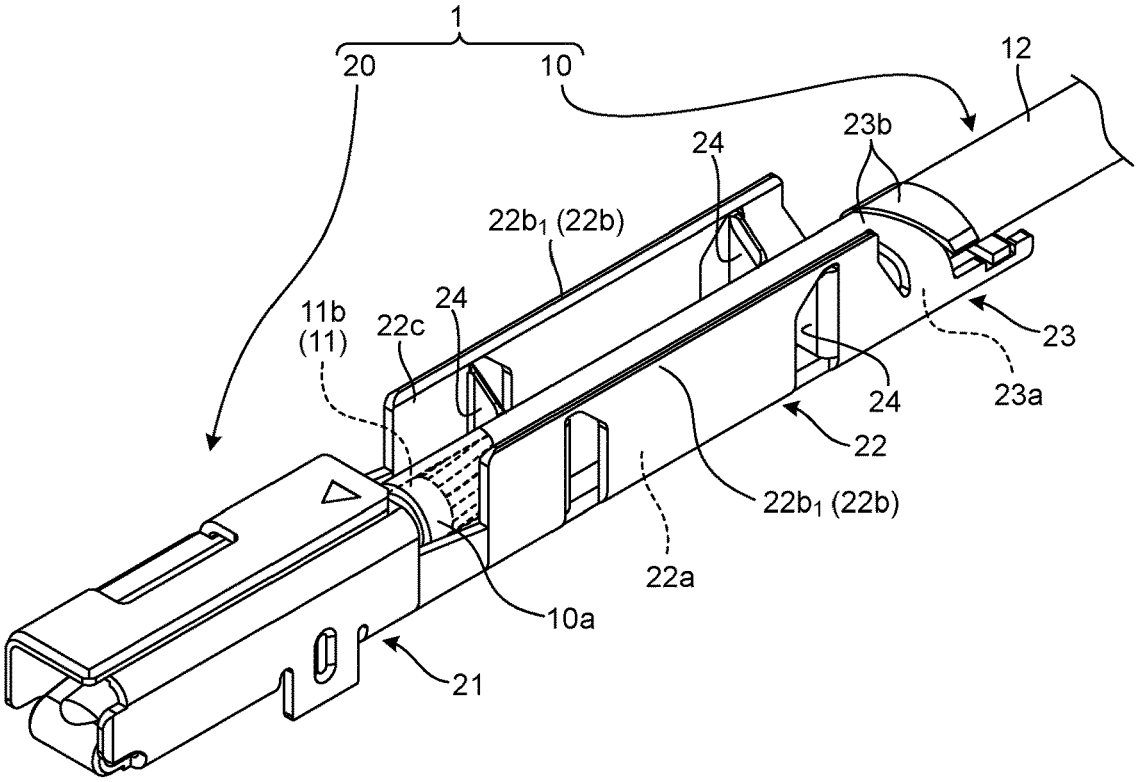
FIG. 2 is a perspective view illustrating the terminal-equipped electric wire of the embodiment.

The core wire connection body 22 has a bottom 22*a* and a pair of cantilever side walls 22*b* and 22*b* erected from the bottom 22*a* and arranged facing each other with a space therebetween (FIGS. 1, 2, and 4). The end region of the electric wire 10 is accommodated in a space surrounded by the bottom 22*a* and the pair of side walls 22*b* and 22*b*. In the core wire connection body 22 described herein, the pair of rectangular side walls 22*b* and 22*b* are suspended from opposite ends of the rectangular bottom 22*a*. The end region of the electric wire 10 is inserted into the space surrounded by the bottom 22*a* and the pair of side walls 22*b* and 22*b* from an opening 22*c* between respective free ends 22$b_1$ and 22$b_1$ of the pair of side walls 22*b* and 22*b* in the core wire connection body 22 (FIGS. 1, 2, and 4).

The core wire connection body 22 further includes at least one set of paired pressure contact bodies 24 and 24 arranged facing each other with a space therebetween between the pair of side walls 22*b* and 22*b* so as to come into pressure contact with the strands 11*a* in the outermost layer of the core wire 11 by cutting the covering 12 of the electric wire 10 inserted from the opening 22*c* (FIGS. 1 to 4). The core wire connection body 22 described herein includes two sets of the paired pressure contact bodies 24 and 24. The two sets of paired pressure contact bodies 24 and 24 are arranged with a space therebetween in an axial direction of the electric wire 10 attached to the core wire connection body 22.

The paired pressure contact bodies 24 and 24 may individually project from the bottom 22*a* toward the opening 22*c*. Alternatively, one of the paired pressure contact bodies 24 and 24 may project from one of the side walls 22*b* toward the other of the side walls 22*b*, and the other of the paired pressure contact bodies 24 and 24 may project from the other of the side walls 22*b* toward the one of the side walls 22*b*. Each pressure contact body 24 described herein is formed as a piece body by partially bending the side wall 22*b* at 90 degrees.

The paired pressure contact bodies 24 and 24 have pressure contact ends 24*a* and 24*a* arranged facing each other with a space therebetween in a facing direction of the pair of side walls 22*b* and 22*b* such that the electric wire 10 is press-fitted therebetween (FIG. 4). The paired pressure contact bodies 24 and 24 are physically and electrically connected to the strands 11*a* in the outermost layer of the core wire 11 by sandwiching the core wire 11 between the respective pressure contact ends 24*a* and 24*a*, and applying a pressing force to the strands 11*a* in the outermost layer from the respective pressure contact ends 24*a* and 24*a*. Thus, in the paired pressure contact bodies 24 and 24, the space between the respective pressure contact ends 24*a* and 24*a* is made smaller than a diameter of the core wire 11. Each pressure contact end 24*a* may be formed as a flat surface extending along an insertion direction of the electric wire 10 from the opening 22*c*, or as a blade-shaped pressure contact blade. Each pressure contact end 24*a* described herein is formed as a flat surface having a thickness equal to a plate thickness of the base material.

The paired pressure contact bodies 24 and 24 also have a core wire introduction portion having a larger width than the space between the respective pressure contact ends 24*a* and 24*a*, as an insertion start point in press-fitting the electric wire 10 between the respective pressure contact ends 24*a* and 24*a*, at ends closer to the opening 22*c*. For example, the paired pressure contact bodies 24 and 24 have inclined portions 24*b* and 24*b* individually continuous from the pressure contact ends 24*a* and 24*a* and in which a space between the inclined portions 24*b* and 24*b* increases toward the opening 22*c* from a border with the pressure contact ends 24*a* and 24*a*, at the ends closer to the opening 22*c* (FIG. 4). The core wire introduction portion is formed by the respective inclined portions 24*b* and 24*b*. Each inclined portion 24*b* may be formed as a flat surface having a thickness equal to the plate thickness of the base material, or as a blade-shaped pressure contact blade. Each inclined portion 24*b* described herein is formed as a pressure contact blade.

The electric wire 10 is inserted into the space surrounded by the bottom 22*a* and the pair of side walls 22*b* and 22*b* from the opening 22*c*. The paired pressure contact bodies 24 and 24 thereby cut the covering 12 of the inserted electric wire 10 by the respective inclined portions 24*b* and 24*b*, exposing the strands 11*a* in the outermost layer of the core wire 11 in the covering 12. The electric wire 10 is more deeply pushed in, so that the strands 11*a* in the outermost layer of the stripped core wire 11 are press-fitted between the respective pressure contact ends 24*a* and 24*a* while being rubbed against the respective pressure contact ends 24*a* and 24*a*. The core wire 11 of the electric wire 10 thereby comes into a pressure contact state between the respective pressure contact ends 24*a* and 24*a*. The strands 11*a* in the outermost layer of the core wire 11 are physically and electrically connected to the terminal fitting 20 via the respective pressure contact ends 24*a* and 24*a*.

As described above, the core wire connection body 22 brings the paired pressure contact bodies 24 and 24 into direct contact with the strands 11*a* in the outermost layer of the core wire 11 (FIG. 4). Thus, the core wire connection body 22 basically cannot bring the paired pressure contact bodies 24 and 24 into direct contact with the strands 11*a* inside the outermost layer of the core wire 11. Moreover, the core wire connection body 22 does not bring the paired pressure contact bodies 24 and 24 into direct contact with all the strands 11*a* in the outermost layer. That is, the core wire 11 is roughly divided into the strands (hereinafter referred to as "contact strands") 11*a* in the outermost layer, electrically connected to the pressure contact bodies 24 in direct contact therewith, and the remaining strands (hereinafter referred to as "non-contact strands") 11*a* indirectly electrically connected to the pressure contact bodies 24 via the contact strands 11*a*. In the core wire 11, even when the number of strands 11*a* increases, not all of the increased strands 11*a* come into direct contact with the pressure contact bodies 24. As the number of strands 11*a* increases, an increasing rate of the non-contact strands 11*a* becomes higher than an increasing rate of the contact strands 11*a*, resulting in an increase in electrical resistance between the strands of the core wire 11.

In the terminal-equipped electric wire 1, electrical connection stability between the core wire 11 and the terminal fitting 20 is enhanced by reducing the electrical resistance between the strands of the core wire 11. Here, the electrical resistance between the strands of the core wire 11 is reduced by physically and electrically connecting all the strands of the core wire 11. To this end, the electric wire 10 is provided with a welded portion 11*b* in which all the strands of the core wire 11 are welded together (FIGS. 1 to 3 and 5).

All the strands 11*a* of the core wire 11 are thereby directly connected by the welded portion 11*b*. Thus, an increase in the electrical resistance between the strands can be prevented. Consequently, the terminal-equipped electric wire 1 of the present embodiment can prevent an increase in electrical resistance in a connection portion between the core wire 11 and the core wire connection body 22.

Moreover, in the electric wire 10, when the strands 11*a* are formed by aluminum or aluminum alloy, an oxide film is formed on the surfaces of the strands 11*a*. When the welded portion 11*b* is formed in the core wire 11, all the strands are welded together with the oxide films removed therefrom. Thus, the increase in the electrical resistance between the strands can be prevented even when the strands 11*a* of the core wire 11 are formed by aluminum or aluminum alloy. While the electric wire 10 is being pushed in, the paired pressure contact bodies 24 and 24 scrape off the oxide films of the strands 11*a* in the outermost layer of the core wire 11 while rubbing against the surfaces of the strands 11*a* by the respective pressure contact ends 24*a* and 24*a*. Thus, the core wire connection body 22 can bring the paired pressure contact bodies 24 and 24 into contact with the strands 11*a* in the outermost layer of the core wire 11 with no oxide film therebetween. Consequently, the terminal-equipped electric wire 1 of the present embodiment can prevent the increase in the electrical resistance in the connection portion between the core wire 11 and the core wire connection body 22 even when the strands 11*a* are formed by aluminum or aluminum alloy.

To be more specific, the welded portion 11*b* may be provided in the end region of the electric wire 10, or between the opposite ends of the electric wire 10. The welded portion 11*b* may also be formed in the core wire 11 covered with the covering 12, or may be formed in the core wire 11 before covered with the covering 12. For example, when the welded portion 11*b* is provided in the end region of the electric wire 10, the welded portion 11*b* is provided in an exposed portion of the core wire 11 at an end 10*a* in the end region of the electric wire 10. In this case, the welded portion 11*b* is formed in the exposed portion of the core wire 11 with the core wire 11 covered with the covering 12. Meanwhile, for example, when the welded portion 11*b* is provided between the opposite ends of the electric wire 10, the welded portion 11*b* is formed in the core wire 11 before covered with the covering 12.

The welded portion 11*b* is formed by, for instance, irradiating a portion of all the strands 11*a* bundled in the core wire 11 with laser light, and welding all the strands of the core wire 11 together by the laser irradiation.

Figure 5:
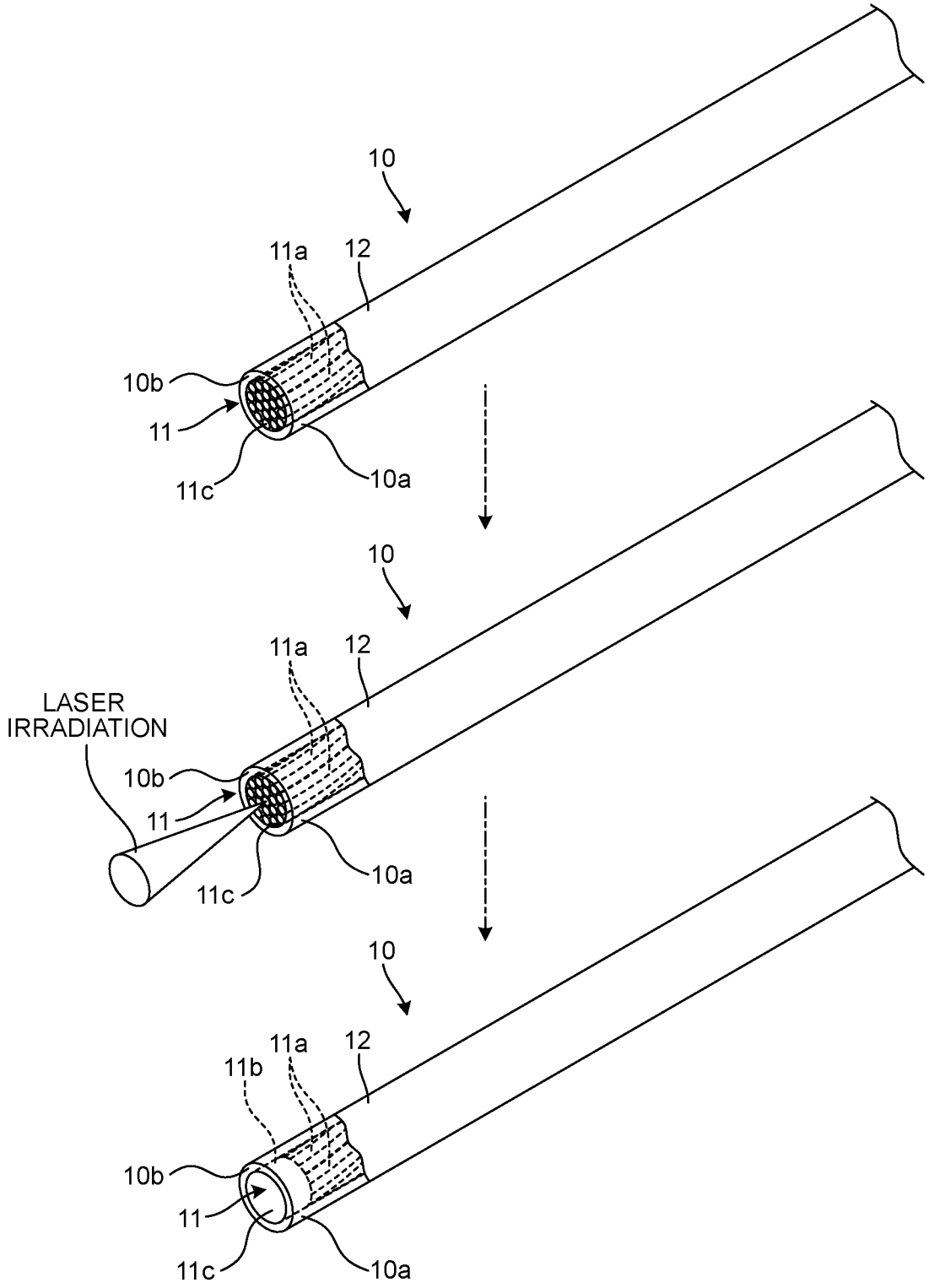
FIG. 5 is an explanatory view illustrating an example of a welded portion forming process.

The welded portion 11*b* described herein is provided in the exposed portion of the core wire 11 at the end 10*a* of the electric wire 10 (FIG. 5). For example, the core wire 11 described herein is covered with the covering 12 to an axial end surface 10*b* at the end 10*a* of the electric wire 10. The core wire 11 has an exposed surface 11*c* exposed along the end surface 10*b* at the end 10*a* of the electric wire 10 (the upper and middle drawings of FIG. 5). Thus, the welded portion 11*b* described herein is formed by irradiating the exposed surface 11*c* of the core wire 11 with laser light, and welding all the strands together by the laser irradiation of the exposed surface 11*c* of the core wire 11 (the middle and lower drawings of FIG. 5). That is, the welded portion 11*b* is a laser welded portion formed by the laser irradiation of the exposed surface 11*c* of the core wire 11. For example, the laser irradiation may be performed on the single electric wire 10 disposed in a jig, or performed sequentially on a plurality of the electric wires 10 arranged on a jig.

The covering connection body 23 has a bottom 23*a* and a pair of barrel pieces 23*b* and 23*b* projecting from opposite ends of the bottom 23*a* (FIGS. 1 and 2). For example, the end region of the electric wire 10 is inserted from an opening 23*c* (FIG. 1) between respective free ends 23*b*, and $\mathbf{23}b_1$ of the barrel pieces 23*b* and 23*b* in the covering connection body 23. The covering 12 is placed on an inner wall surface (bottom surface) of the bottom 23*a*. The covering connection body 23 is wound around the covering 12 in the end region of the electric wire 10 while, for example, pressurizing and deforming the respective barrel pieces 23*b* and 23*b*.

As described above, the terminal-equipped electric wire 1 of the present embodiment can prevent the increase in the electrical resistance in the connection portion between the core wire 11 and the core wire connection body 22. Consequently, the electrical connection stability between the core wire 11 and the terminal fitting 20 can be enhanced.

In the electric wire 10 described herein, the exposed surface 11*c* along the end surface 10*b* at the end 10*a* is irradiated with laser light without partially stripping the covering 12 in forming the welded portion 11*b*. Thus, the terminal-equipped electric wire 1 does not require the operation of stripping the covering 12, thereby preventing an increase in operation process.

Figure 6:
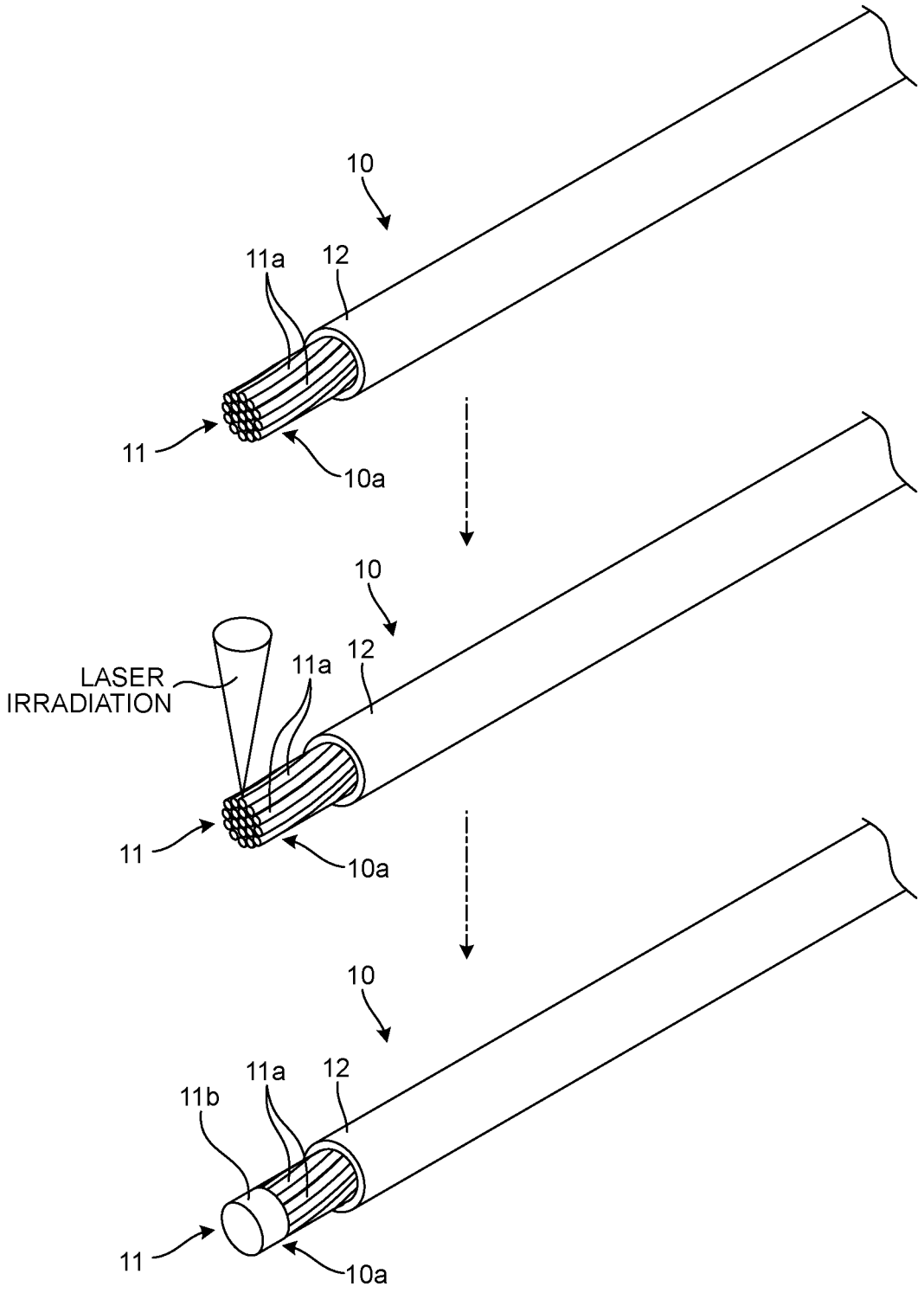
FIG. 6 is an explanatory view illustrating another example of the welded portion forming process.

In the electric wire 10, however, the core wire 11 is exposed in a columnar shape at the end 10*a* by stripping the covering 12 at the end 10*a* in some cases (the upper and middle drawings of FIG. 6). The terminal-equipped electric wire 1 of the present embodiment can be also applied to the electric wire 10 having such a columnar exposed portion of the core wire 11. For example, the electric wire 10 is disposed in a jig before attached to the terminal fitting 20, and all the strands are welded together by irradiating the columnar exposed portion of the core wire 11 with laser light from its outer peripheral side (the middle and lower drawings of FIG. 6). Moreover, for example, the terminal fitting 20 may be used as a jig after the electric wire 10 is attached to the terminal fitting 20, and all the strands may be welded together by irradiating the columnar exposed portion of the core wire 11 with laser light from its outer peripheral side.

When the terminal fitting according to the present invention connects a plurality of the electric wires 10, the electric wires 10 may be connected to at least one set of the paired pressure contact bodies 24 and 24 by increasing the lengths of the respective pressure contact ends 24*a* and 24*a* of the paired pressure contact bodies 24 and 24 according to the number of electric wires 10 as a connection target. Additionally, when the terminal fitting according to the present invention connects the electric wires 10, at least one set of the paired pressure contact bodies 24 and 24 may be provided for each of the electric wires 10.

In the core wire of the terminal-equipped electric wire according to the present embodiment, all the strands are directly connected by the welded portion. Thus, the increase in the electrical resistance between the strands can be prevented. Consequently, the terminal-equipped electric wire according to the present embodiment can prevent the increase in the electrical resistance in the connection portion between the core wire and the core wire connection body, enhancing the electrical connection stability between the core wire and the terminal fitting.

Moreover, in the electric wire, when the strands are formed by aluminum or aluminum alloy, the oxide film is formed on the surfaces of the strands. When the welded portion is formed in the core wire, however, all the strands are welded together with the oxide films removed therefrom. Thus, the increase in the electrical resistance between the strands can be prevented even when the strands of the core wire are formed by aluminum or aluminum alloy. While the electric wire is being pushed in, the paired pressure contact bodies scrape off the oxide films of the strands in the outermost layer of the core wire while rubbing against the surfaces of the strands. Thus, the core wire connection body can bring the paired pressure contact bodies into contact with the strands in the outermost layer of the core wire with no oxide film therebetween. Consequently, the terminal-equipped electric wire according to the present embodiment can prevent the increase in the electrical resistance in the connection portion between the core wire and the core wire connection body even when the strands are formed by aluminum or aluminum alloy.

As described above, the terminal-equipped electric wire according to the present embodiment can prevent the increase in the electrical resistance in the connection portion between the core wire and the core wire connection body, thereby enhancing the electrical connection stability between the core wire and the terminal fitting.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal-equipped electric wire comprising:

an electric wire in which a core wire including a plurality of strands is covered with a covering; and a terminal fitting attached to the electric wire, wherein the terminal fitting includes a core wire connection body physically and electrically connected to the core wire, the core wire connection body has a bottom, a pair of cantilever side walls erected from the bottom and arranged facing each other with a space therebetween, and at least one set of paired pressure contact bodies arranged facing each other with a space therebetween between the pair of side walls so as to come into pressure contact with the strands in an outermost layer of the core wire by cutting the covering of the electric wire inserted from an opening between respective free ends of the pair of side walls, and the electric wire is provided with a welded portion in which all the strands of the core wire are directly connected to each other.

2. The terminal-equipped electric wire according to claim 1, wherein the welded portion is provided in an exposed portion of the core wire at an end of the electric wire.

3. The terminal-equipped electric wire according to claim 2, wherein the core wire has an exposed surface exposed along an end surface at the end of the electric wire, and the welded portion is a laser welded portion in which all the strands are welded together by laser irradiation of the exposed surface of the core wire.

4. The terminal equipped electric wire according to claim 1, wherein the welded portion is provided at an end region of the electric wire prior of inserting it into the terminal fitting.

* * * * *